US008146741B2

(12) United States Patent
Matsuoka et al.

(10) Patent No.: US 8,146,741 B2
(45) Date of Patent: Apr. 3, 2012

(54) BLISTER PACKAGE

(75) Inventors: Kensuke Matsuoka, Ibaraki (JP); Yoshihiro Iwao, Ibaraki (JP); Katsuhiro Okada, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 257 days.

(21) Appl. No.: 12/618,931

(22) Filed: Nov. 16, 2009

(65) Prior Publication Data

US 2010/0122927 A1 May 20, 2010

(30) Foreign Application Priority Data

Nov. 17, 2008 (JP) ..... 2008-293850

(51) Int. Cl.
*A61B 17/06* (2006.01)

(52) U.S. Cl. ..... 206/440; 206/469; 220/359.1; 424/449

(58) Field of Classification Search ..... 206/5.1, 206/438, 440, 461, 466, 469, 528, 532; 220/359.1
See application file for complete search history.

(56) References Cited

U.S. PATENT DOCUMENTS 4,558,782 A * 12/1985 Iverson et al. ..... 220/359.1
5,833,071 A * 11/1998 Ray ..... 206/532
5,950,830 A * 9/1999 Trigger ..... 206/440
5,983,608 A 11/1999 Wu et al.
6,889,825 B2 * 5/2005 Ichikawa et al. ..... 206/5.1
7,377,394 B2 * 5/2008 Buss ..... 220/359.1
2002/0166792 A1 11/2002 Filion et al.
2003/0138479 A1 * 7/2003 Mizota et al. ..... 424/443
2005/0023276 A1 * 2/2005 Hopp et al. ..... 219/725
2010/0314278 A1 * 12/2010 Fonteyne et al. ..... 206/469

FOREIGN PATENT DOCUMENTS

JP 2003-500305 1/2003
JP 2008-133055 6/2008
WO 02/083520 10/2002

OTHER PUBLICATIONS

European Search Report issued Feb. 17, 2010 in European Patent Application No. 09176192.4.

* cited by examiner

*Primary Examiner* — Luan K Bui
(74) *Attorney, Agent, or Firm* — Wenderoth, Lind & Ponack, L.L.P.

(57) ABSTRACT

A blister package comprises a blister and a cover sheet, and the blister has a groove formed in an outer edge section of the blister. The outer edge section of the blister includes an outer region and an inner region, the groove is formed on the inward side of the outer region, and the inner region is formed on the inward side of the groove. The peel strength between the outer region and the cover sheet is greater than the tear strength of the cover sheet, and the peel strength between the inner region and cover sheet is smaller than the tear strength of the cover sheet.

5 Claims, 7 Drawing Sheets

BLISTER PACKAGE

TECHNICAL FIELD OF THE INVENTION

The present invention relates to a blister package. More particularly, the present invention relates to a blister package whose cover sheet can be easily opened.

BACKGROUND OF THE INVENTION

In recent years, a transdermal absorption type patch preparation for transdermal administration of a drug by adhesion of an adhesive sheet containing the drug to the skin has been put to practical use (such "transdermal absorption type adhesive preparation" is also referred to as a "transdermal absorption patch", and to be also called in the following description as a "transdermal absorption patch").

A transdermal absorption patch is basically formed by laminating an adhesive layer containing a drug on one surface of a plastic support such as polyester, polyethylene and the like, and coating an exposed surface of the adhesive layer with a separator. Generally, such a transdermal absorption patch is independently packed with a package (film) impermeable to water, gas and the like to prevent volatilization of the drug contained in the adhesive layer and influence of humidity.

However, in an individually packed transdermal absorption patch, an adhesive may stick out from the edge of the patch, attach to the inside of the package (film) and, when in use, make it difficult to take out the transdermal absorption patch from the package. Particularly, when a transdermal absorption promoter, a plasticizer, a tackifier, a liquid component and the like are contained in an adhesive layer, the adhesive easily sticks out from the edge and taking out of the transdermal absorption patch becomes markedly difficult.

To solve the above-mentioned inconveniences, a blister pack, namely, a blister (container having a concave portion to be a concave to accommodate the content) is often employed, where a transdermal absorption patch is placed in the concave recess, and a cover sheet is adhered to the outer circumference of the blister to enclose the patch.

For hygiene or medical goods and pharmaceutical products, it is a recent tendency to place an importance on a package structure preventing easy opening by children (what is called a "child-proof package structure"). In the case of blister packaging, easy opening is prevented by the use of a cover sheet having a high tear strength, increased adhesion between a blister and a cover sheet and the like. In some cases, such packages are difficult to open even for adults without a knife or scissors. In general, blister packaged goods require use of a knife, scissors etc. to tear open the package and take out the contents. To open a blister packaged good, therefore, it is substantially necessary to always carry a knife, scissors and the like. In addition, when a package is torn with a sharp blade such as a knife, scissors and the like, problems occur since the contents may also be cut, and one who intends to open a blister packaged good may be injured with the blade. Therefore, child-proof package structures that can be opened without using a knife or scissors have been proposed in recent years. However, all of them are problematic in that the structure is complicated or opening operation is complicated (see patent document 1, patent document 2).

patent document 1: JP-T-2003-500305 patent document 2: JP-A-2008-133055

DISCLOSURE OF THE INVENTION

Problems to be Solved by the Invention

In view of the above-mentioned situation, the problem to be solved by the present invention is to provide a blister package that cannot be opened easily by infants, but can be opened easily, certainly and safely by a user when in use.

Means of Solving the Problems

The present inventors have conducted intensive studies in an attempt to solve the aforementioned problems and found that a cover sheet of a blister can be easily broken by forming a groove in an outer edge section where the cover sheet is adhered, and moving, along the groove, a pen tip or nail tip pressed against the groove from the surface of the adhered cover sheet, and the cover sheet can thus be opened easily even without using a knife or scissors.

Accordingly, the present invention provides the following.

(1) A blister package comprising a blister and a cover sheet, wherein the blister has a groove formed in an outer edge section thereof where the cover sheet is adhered and the groove is free of adhesion of the sheet.

(2) The blister package of the above-mentioned (1), wherein the cover sheet is adhered to the outermost circumference of the aforementioned outer edge section, the groove is formed on the inward side of the outermost circumference, and the cover sheet is not adhered to the area on the inward side of the groove.

(3) The blister package of the above-mentioned (1), wherein the cover sheet is adhered to the outermost circumference of the aforementioned outer edge section, the groove is formed on the inward side of the outermost circumference, and the cover sheet is weakly adhered to the area on the inward side of the groove.

(4) The blister package of the above-mentioned (2) or (3), wherein the peel strength between the outermost circumference and the cover sheet is 12 N/15 mm or above.

(5) The blister package of the above-mentioned (3) or (4), wherein the weakly adhered cover sheet has a peel strength of 0.5-10 N/15 mm.

(6) The blister package of any of the above-mentioned (1)-(5), wherein the cover sheet has a tear strength of 0.2-1.2 N/cm.

(7) The blister package of any of the above-mentioned (1)-(6), which is used for a transdermal absorption patch.

Effect of the Invention

In the blister package of the present invention, when a pen tip, nail tip or the like is pressed against the groove formed in the outer edge section of a blister from the surface of the cover sheet, the cover sheet can only disperse its force up to the clearance of the groove. Therefore, the cover sheet can be broken with a small force applied with a pen tip, nail tip or the like. When the pen tip, nail tip or the like is moved along the groove as the sheet becomes broken therealong, the cover sheet is further torn and the package can be opened. Alternatively, a broken piece of the sheet torn along the groove may be grasped and pulled to tear the sheet, whereby the package can be opened.

According to the blister package of the present invention, therefore, the package can be opened safely without using a sharp blade such as a knife, scissors and the like. In addition, since a tool used for breaking the cover sheet does not enter a concave portion holding the contents, the contents are free of damage during breakage of the cover sheet.

Although the cover sheet can be broken by pressing a pen tip, nail tip or the like against the groove from the surface of the cover sheet, to open by a different method, a knife or scissors need to be used like a conventional method. Therefore, the present invention also has an effect of preventing infants from accidentally opening the package.

EXPLANATION OF SYMBOLS

Figure 1:
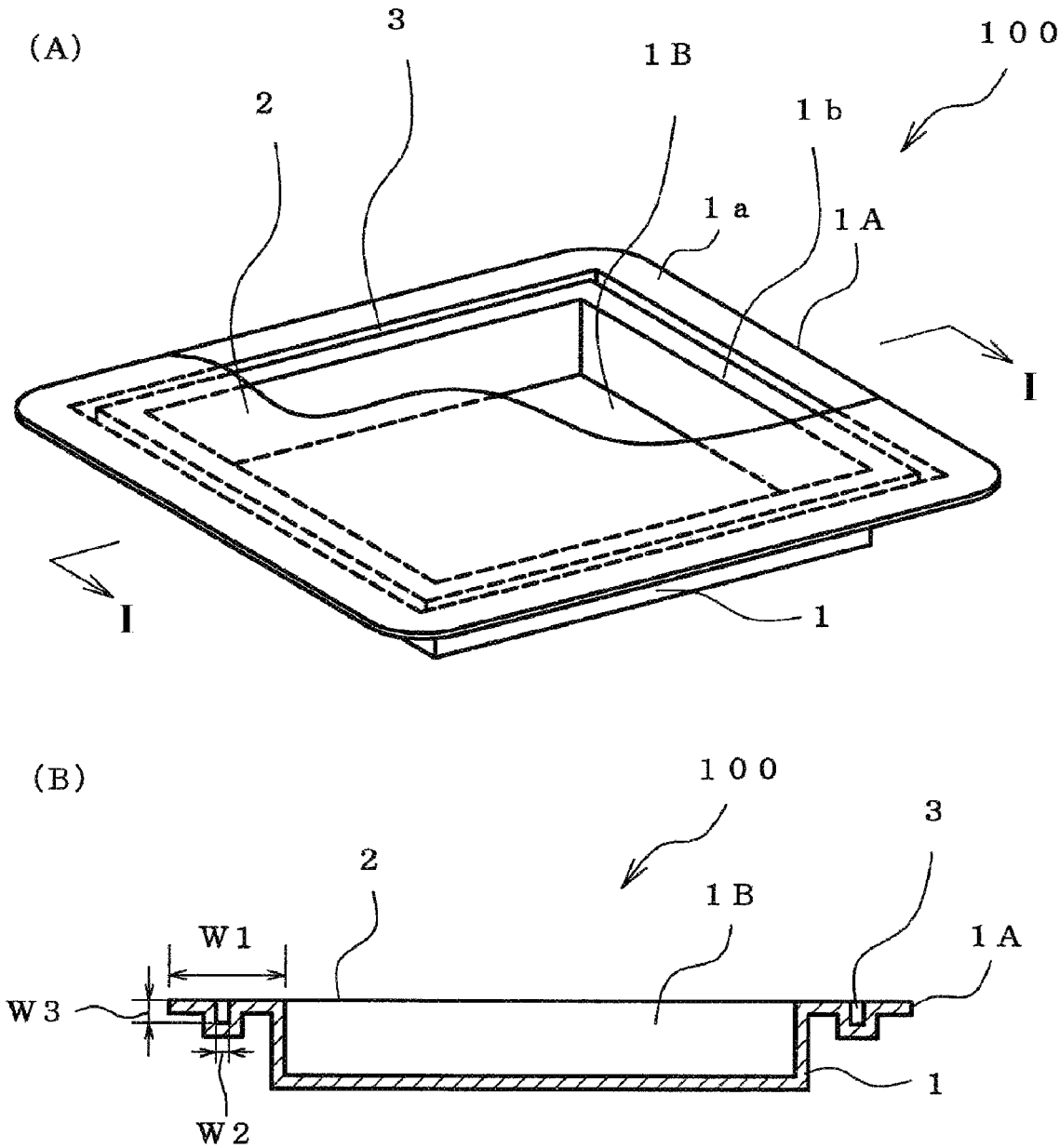
FIG. 1 shows the blister package of a first embodiment of the present invention, wherein Fig. (A) is a perspective view including a partly broken away view, and Fig. (B) is a sectional view along line I-I of Fig. (A).

1 blister
1A outer edge section
1B concave portion
1*a* region on the outward side of groove in outer edge section (i.e. an outer region)
1*b* region on the inward side of groove in outer edge section (i.e. an inner region)
2 cover sheet
3 groove
100 blister package

DETAILED DESCRIPTION OF THE INVENTION

The present invention is explained in more detail in the following by referring to the drawings.

FIG. 1 shows the blister package of a first embodiment of the present invention, wherein Fig. (A) is a perspective view including a partly broken away view, and Fig. (B) is a sectional view along line I-I of Fig. (A).

As shown in FIG. 1, the blister package 100 of the first embodiment has a quadrate plane shape, blister 1 has a concave portion 1B to keep the contents, and cover sheet 2 is adhered to an outer edge section 1A surrounding the concave portion 1B. The outer edge section 1A has a groove 3 on the whole circumference, and the cover sheet 2 is adhered to the outer region 1*a* of the groove 3 (i.e., the outermost circumference).

As shown in the package 100 of the above-mentioned first embodiment, the blister package of the present invention is mainly characterized in that it comprises blister 1 and cover sheet 2, a groove 3 is formed in the outer edge section 1A where the cover sheet 2 is adhered to the blister 1, and the groove 3 is free from adhesion of the cover sheet 2.

In other words, since a groove 3 free from adhesion of the cover sheet 2 is formed in the outer edge section 1A of blister 1, when a pen tip, nail tip or the like (not shown) is pressed against the groove 3 from the surface of the cover sheet 2 adhered to the outer edge section 1A (see FIG. 1), the cover sheet can be broken with a small force applied with a pen tip, nail tip or the like since the cover sheet can only disperse its force up to the clearance of the groove. When the pen tip, nail tip or the like is moved along the groove 3 as the cover sheet 2 becomes broken therealong, the cover sheet 2 is further torn and the package can be opened. According to the blister package of the present invention, the cover sheet 2 can be broken easily and certainly without using a sharp blade such as a knife, scissors and the like. In addition, since a tool used for breaking the cover sheet does not enter a concave portion housing the contents, the contents are free of damage.

Figure 2:
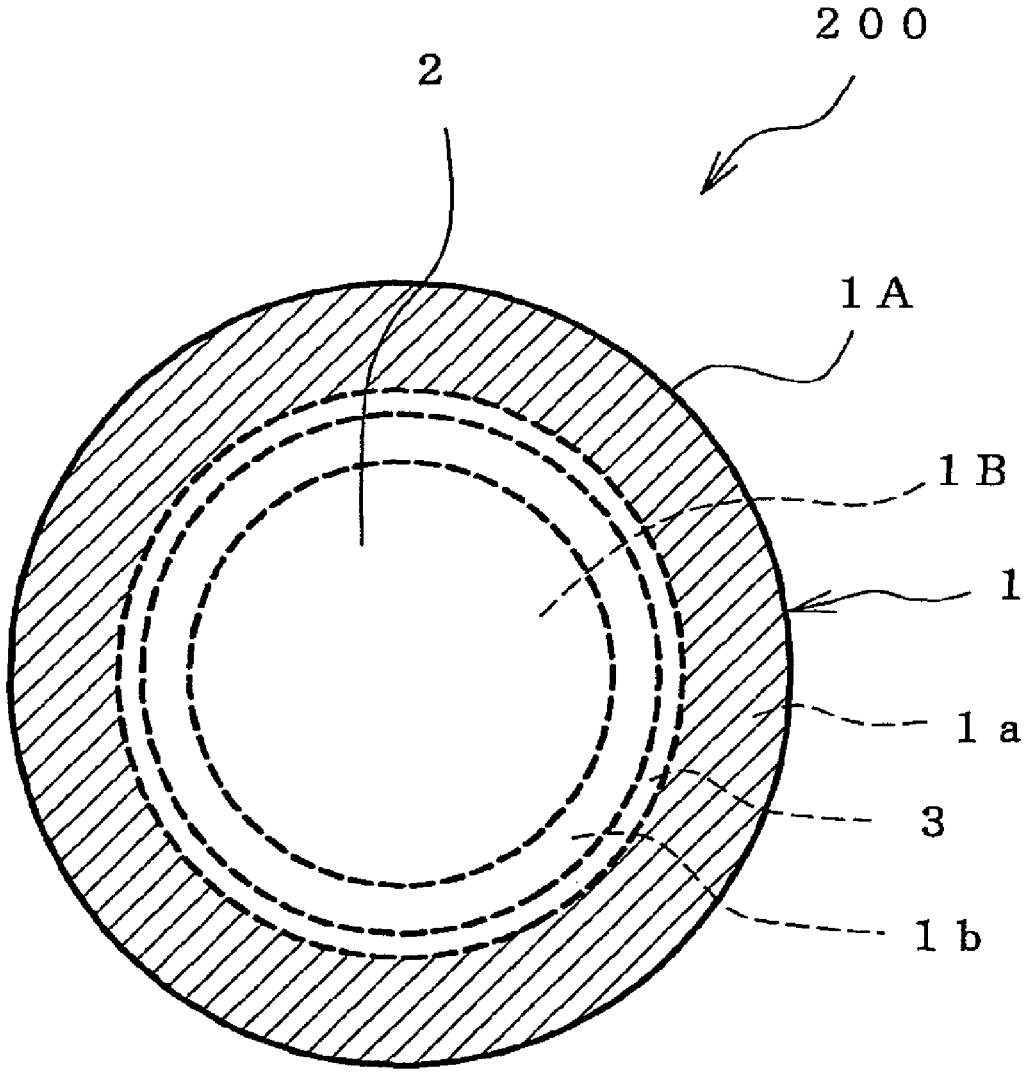
FIG. 2 is a plane view of the blister package of a second embodiment of the present invention.

FIG. 2 is a plane view of the blister package of the second embodiment of the present invention, where the blister 1 is shown through the cover sheet 2 and hatching in the Figure shows the adhered area. Cover sheet 2 is adhered to the outer region 1*a* (outermost circumference) on the outward side of groove 3 in the outer edge section 1A of the blister 1.

Blister package 100 in the above-mentioned first embodiment has a quadrate plane shape. In the present invention, the plane shape of the blister package is not particularly limited and, as in the blister package 200 of the second embodiment, a package having a circular plane shape may be employed. A package having a circular plane shape is advantageous in that the cover sheet can be broken smoothly along the groove using a pen tip, nail tip or the like due to the absence of a corner in the groove.

In addition, the plane shape of the blister package of the present invention may be other than quadrate or circle, and may be ellipse, oval, triangle, pentagon and the like.

In the blister packages 100 and 200 shown in FIG. 1 and FIG. 2, a groove 3 is formed on the whole circumference of the outer edge section 1A of blister 1. As a result, the cover sheet 2 can be certainly broken open entirely to facilitate removal of the contents of the concave portion 1B, by thrusting a pen tip, nail tip or the like against the groove 3 from the surface of the cover sheet 2 to break the sheet, and moving the pen tip, nail tip or the like almost along the full-length of the groove 3.

Figure 3:
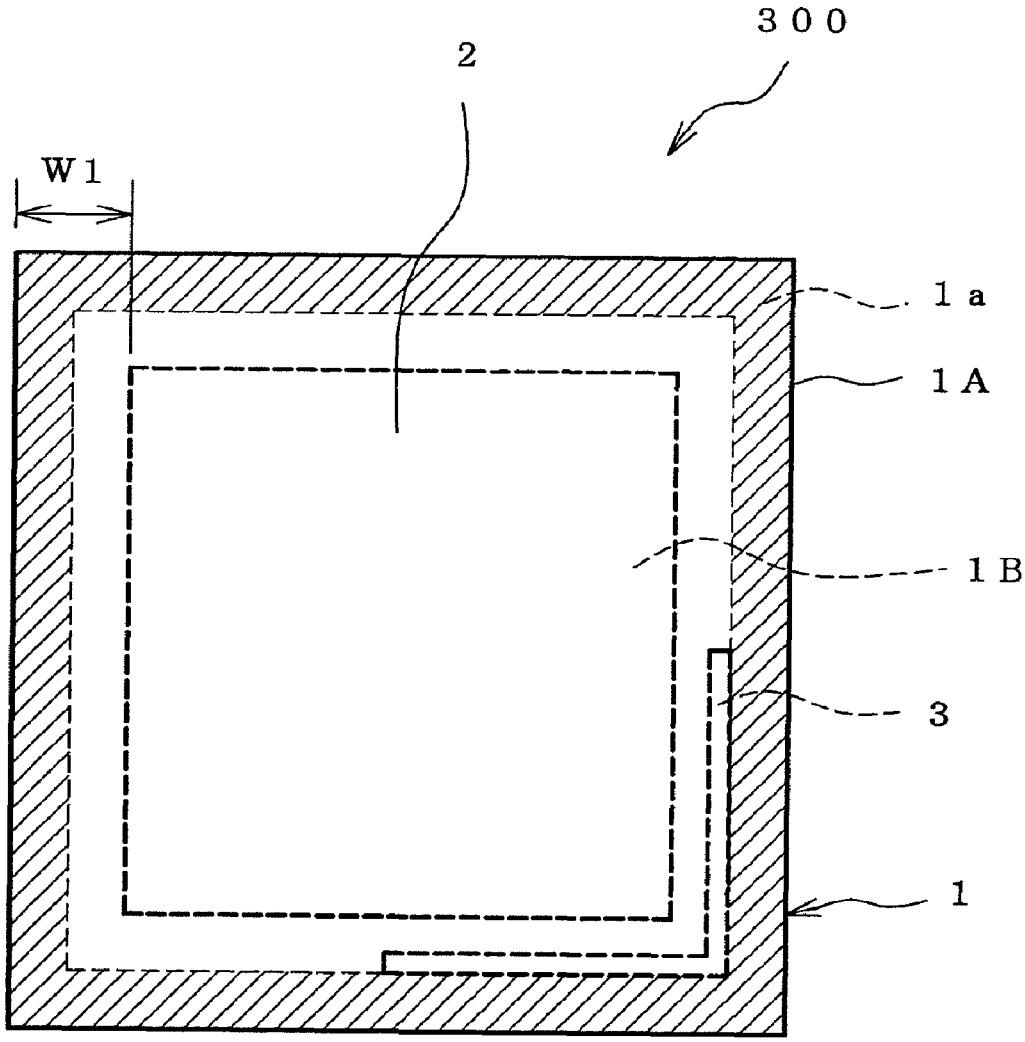
FIG. 3 is a plane view of the blister package of a third embodiment of the present invention.
Figure 4:
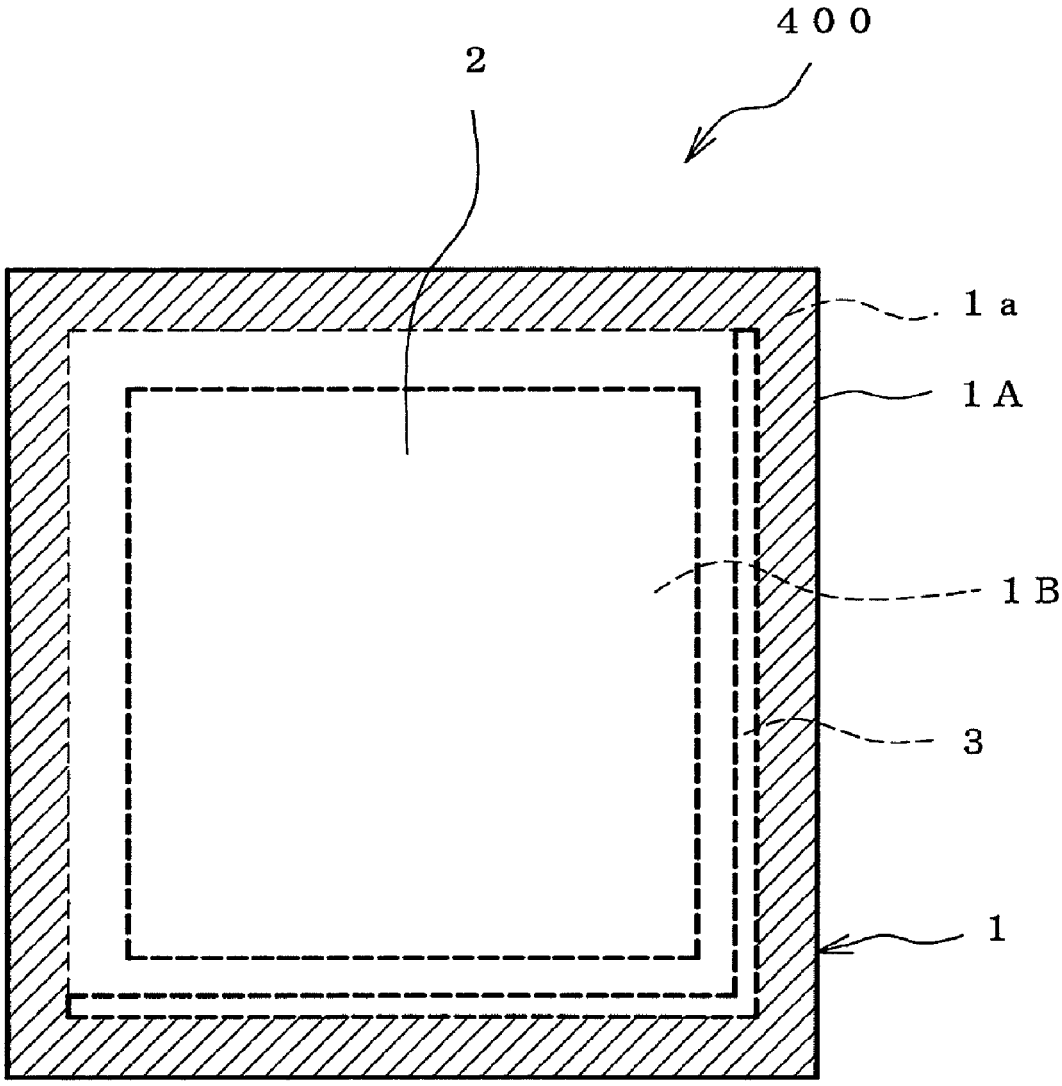
FIG. 4 is a plane view of the blister package of a fourth embodiment of the present invention.

FIG. 3 and FIG. 4 are plane views of the blister packages of the third and fourth embodiments of the present invention. The Figures show blister 1 and cover sheet 2, with hatching indicating adhered regions in the Figures. That is, the cover sheet 2 is adhered to the outer region 1*a* (outermost circumference) on the outward side of groove 3 in the outer edge section 1A of blister 1.

Blister packages 300 and 400 of the third and fourth embodiments have a quadrate plane shape. However, groove 3 is not formed on the whole circumference of the outer edge section 1A of blister 1, but formed along one corner of the outer edge section 1A. That is, an ancyroid groove 3 is formed along two straight-line portions forming one corner of the outer edge section 1A of blister 1.

As shown in the blister packages 300 and 400, the blister package of the present invention does not necessarily require formation of groove 3 on the whole circumference of the outer edge section 1A of blister 1. To be precise, when groove 3 is formed such that at least a broken piece that can be held with fingers is produced by breaking the cover sheet 2 along groove 3, the package can be opened by breaking the cover sheet 2 along the groove 3, and further breaking (tearing) the cover sheet 2 by pulling the broken piece of the sheet with fingers and the like.

Figure 5:
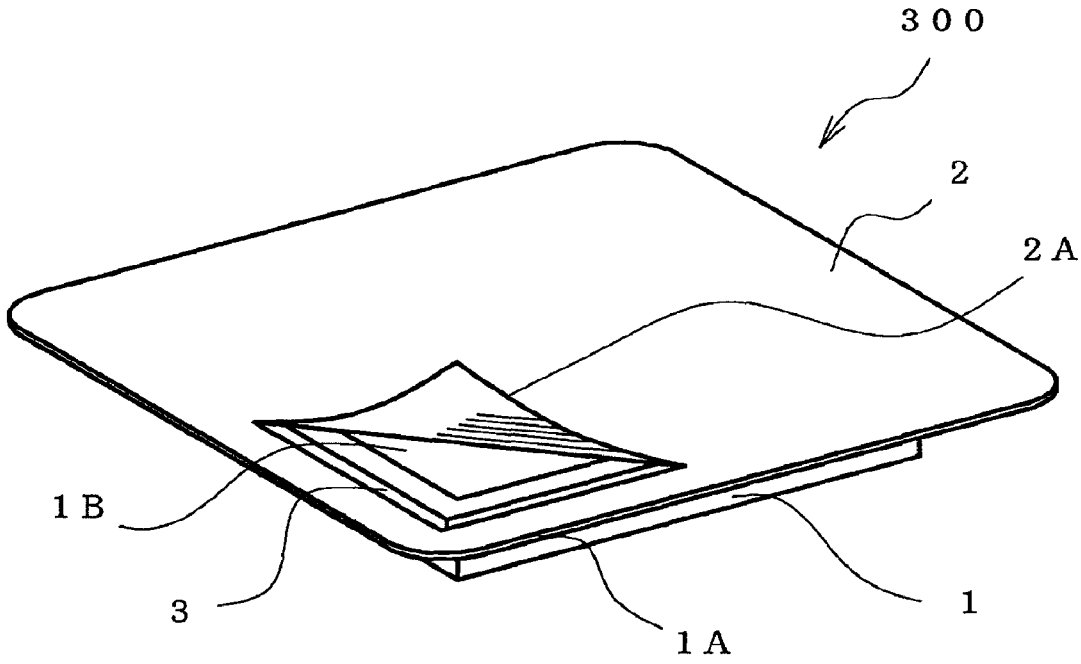
FIG. 5 is a perspective view of the blister package of FIG. 3 with the cover sheet partly broken away.

FIG. 5 shows the blister package 300 of the above-mentioned FIG. 3 with the cover sheet 2 partly broken away. As is clear from FIG. 5, groove 3 is formed along at least one corner of the outer edge section 1A, and the cover sheet 2 is broken along groove 3. As a result, a broken sheet piece 2A is formed, which can be held with fingers etc. with ease to preferably facilitate the opening operation thereafter. When a groove is not formed on the whole circumference of the outer edge section 1A of blister 1, therefore, the plane shape of the blister package preferably has at least one corner (e.g., quadrate and the like), and the groove is preferably formed along one corner of the outer edge section 1A of blister 1.

Figure 6:
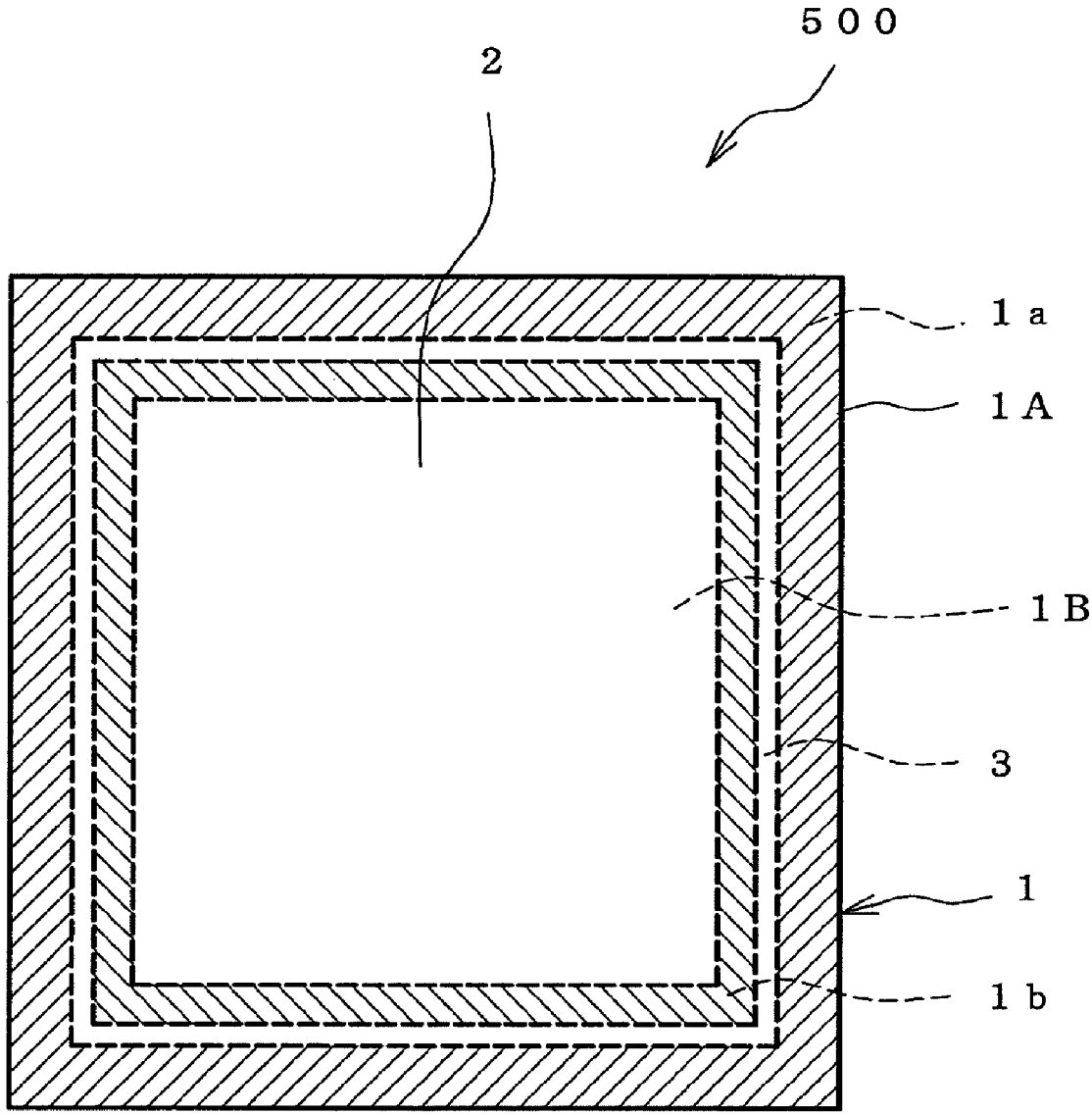
FIG. 6 is a plane view of the blister package of a fifth embodiment of the present invention.

FIG. 6 shows a plane view of the blister package of the fifth embodiment of the present invention. The Figure shows blister 1 and cover sheet 2, with hatching indicating adhered region. That is, the cover sheet 2 is adhered to both region 1*b* on the inward side of groove 3 and region 1*a* (outermost circumference) on the outward side of groove 3 in the outer edge section 1A of blister 1.

As in the blister package 500 of the fifth embodiment, when the cover sheet 2 is adhered to both region 1*b* on the inward side of groove 3 and region 1*a* (outermost circumference) on the outward side of groove 3 in the outer edge section 1A, the cover sheet 2 is free of misalignment during breakage thereof along groove 3, since the sheet is fixed on both sides of the groove 3, whereby the cover sheet 2 can be broken more easily.

Figure 7:
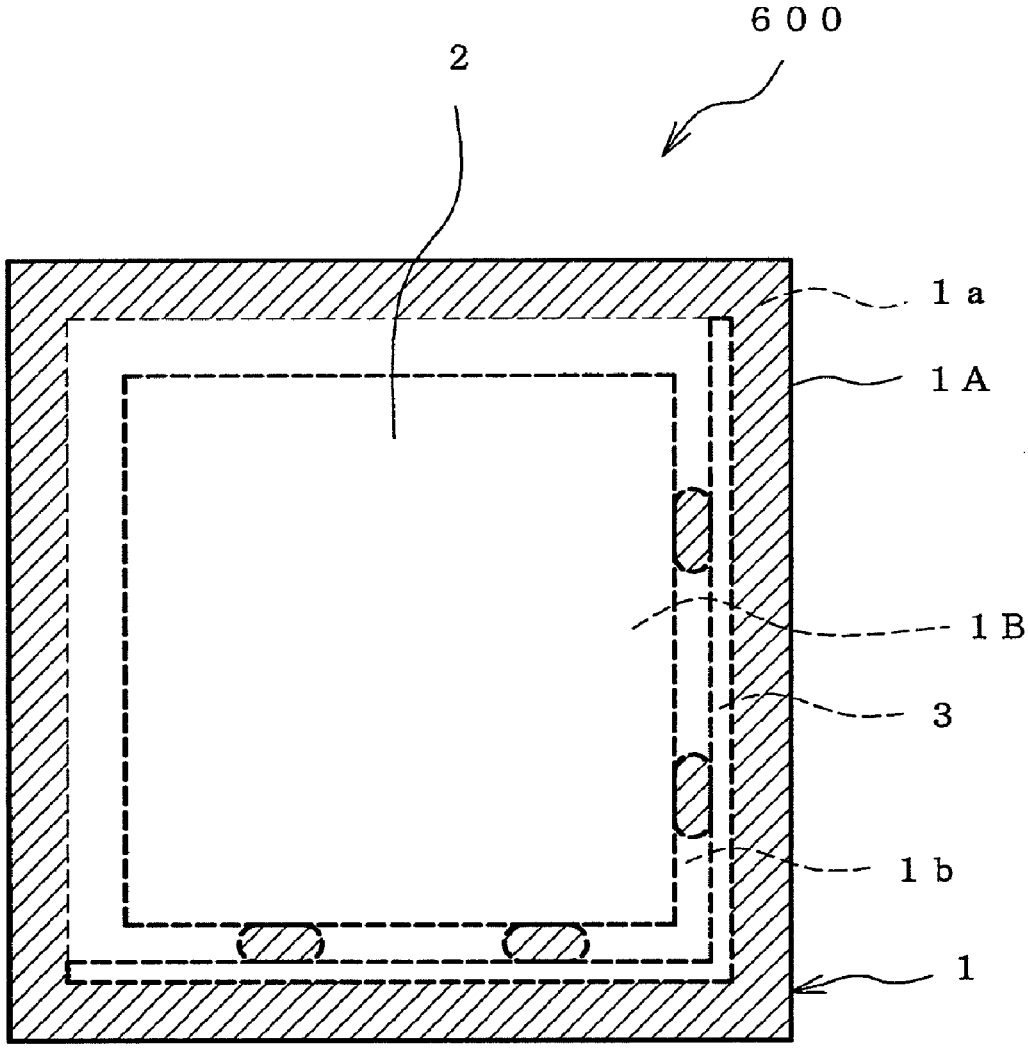
FIG. 7 is a plane view of the blister package of a sixth embodiment of the present invention.

FIG. 7 shows a plane view of the blister package of the sixth embodiment of the present invention. The Figure shows blister 1 and cover sheet 2, with hatching indicating adhered region. That is, an ancyroid groove 3 is formed along two straight-line portions forming one corner of the outer edge section 1A of blister 1, the cover sheet 2 is continuously adhered to the outermost circumference 1*a* of outer edge section 1A, and the cover sheet 2 is partially adhered to the region 1*b* on the inward side of groove 3 in the outer edge section 1A.

In the blister package 600 of the sixth embodiment, the cover sheet 2 is free of misalignment during breakage thereof along groove 3, since the sheet is fixed on both sides of the groove 3, whereby the cover sheet 2 can be broken along groove 3 more easily. After breakage of cover sheet 2 along groove 3, cover sheet 2 is only weakly adhered to region 1*b* on the inward side of groove 3 in the outer edge section 1A. Thus, the sheet can be easily broken (torn) thereafter.

In the blister package 600 of the above-mentioned sixth embodiment, adhesion parts (adhesion regions) with the cover sheet 2 are formed in spots in region 1*b* on the inward side of groove 3 in the outer edge section 1A. The adhesion parts (adhesion regions) may be formed in a grid pattern to achieve weak adhesion.

In addition, the adhesion force at the adhesion part (adhesion region) with cover sheet 2 in region 1*b* on the inward side of groove 3 in the above-mentioned outer edge section 1A of blister 1 is preferably adjusted such that peel strength on detaching the cover sheet 2 from the region 1*b* is smaller than the tear strength of the cover sheet 2. As a result, breakage of the cover sheet 2 during detachment thereof after breaking along the groove 3 can be prevented.

The blister package of the present invention can be constituted in various forms, as shown in the above-mentioned first to sixth embodiments. To sufficiently maintain the tight-sealing of the package inside, prevent accidental opening during transportation or preservation, and ensure a child-proof package structure, the peel strength between blister 1 and a cover sheet (i.e., peel strength of cover sheet 2 in region 1*a* (outermost circumference) on the outward side of groove 3 in the outer edge section 1A) is desirably higher than the tear strength of the cover sheet.

The size (whole size) of the blister package of the present invention is appropriately determined depending on the packed contents, and is not particularly limited. For example, when it is used as a package for an adhesive preparation for the skin, transdermal absorption patch and the like to be mentioned below, preferably, the size in plane view is generally greater than 4 cm×4 cm quadrate and smaller than 20 cm×20 cm quadrate.

In addition, the shape of the outer edge section 1A is not particularly limited. Generally, the outer edge section 1A is formed to enclose the concave portion 1B that holds the contents, and has almost the same width throughout the section, and the width (width in the direction orthogonal to the outer circumference of outer edge section 1A: W1 in FIG. 1(B)) is generally set to fall within the range of 5-20 mm.

The width of groove 3 formed in the outer edge section 1A (width in the direction orthogonal to axis line of groove 3: W2 in FIG. 1(B)) is not particularly limited, and is preferably about 1-5 mm, more preferably 2-3 mm. When the width of groove 3 is less than 1 mm, a pen tip, nail tip or the like cannot be easily thrust against groove 3, and when it is more than 5 mm, the stress on the cover sheet 2 produced by a pen tip, nail tip or the like thrust against groove 3 is dispersed in the plane direction, unpreferably making the breakage difficult.

The depth of groove 3 (W3 in FIG. 1(B)) is preferably about 1-5 mm, more preferably 2-3 mm. When the depth of groove 3 is less than 1 mm, the breakage becomes difficult, and a pen tip, nail tip or the like does not easily come off from groove 3. A depth of the groove 3 of more than 5 mm is not preferable since blister molding tends to be difficult.

Groove 3 is preferably formed at a position 3 mm or more distant from the end of the outermost circumference of the outer edge section 1A, so that adhesion region of the outer edge section 1A and the cover sheet 2 can be secured.

In the blister package of the present invention, the material of blister 1 is not particularly limited, and commodity plastics such as polyethylene, polypropylene, polyamide, polyester, polyvinyl chloride and the like can be used. Blister 1 can be obtained by molding, for example, a single layer sheet consisting of any one kind of these commodity plastics or a laminate sheet consisting of two or more kinds thereof according to a known molding method such as vacuum molding method, pressure molding method, vacuum-pressure molding method, compression molding method and the like. When the contents require high gas barrier property, blister 1 can be obtained by forming a gas barrier sheet coated with an ethylene-vinyl acetate copolymer saponified product, polyacrylonitrile, polyvinylidene chloride and the like on the above-mentioned commodity plastic sheet. When the cover sheet 2 is thermally adhered by heat sealing, the surface to be adhered to cover sheet 2 is preferably coated with a thermally adhesive material such as a polyolefin hot-melt adhesive, a sealant film of polyacrylonitrile etc. and the like. The thickness of the coating layer (adhesive layer) is preferably about 10-400 μm.

While the wall thickness (thickness of sheet to be molded) of blister 1 varies depending on the contents, it is generally selected from the range of 30-500 μm, and preferably about 100-200 μm from the aspects of shape retaining property.

As cover sheet 2, a sheet comprised of a material similar to that of the above-mentioned commodity plastic sheet for blister 1 or a gas barrier laminate sheet can be used (single layer, laminate). In addition, a laminate sheet obtained by laminating a metal foil such as aluminum foil and the like, a metal vapor deposition film such as aluminum vapor deposition film and the like, a metal oxide vapor deposition film such as silicon oxide vapor deposition film and the like on the above sheet can be used.

While the thickness of the cover sheet 2 is not particularly limited, it is generally 10-200 μm, preferably 20-100 μm. When the thickness is less than 10 μm, wrinkles and sagging may be developed on the sheet during bag-making steps and the like, airtightness cannot be maintained easily, or breakage due to low strength may occur. When the thickness is more than 200 μm, the package cannot be torn easily and unpreferably resists opening.

The cover sheet 2 preferably has a tear strength within the range of 0.2-1.2 N, more preferably 0.3-0.7 N. When the tear strength of the cover sheet is less than 0.2 N, the cover sheet may be broken or pinhole may be developed before use (opening) during transportation, preservation and the like of the package, and when the strength is more than 1.2 N, the package cannot be opened easily with a pen tip, nail tip or the like, and a knife or scissors may be necessary for opening.

Specific embodiment of cover sheet 2 is not particularly limited as long as it can tightly seal the concave portion of the blister. From the aspects of impermeability of package contents and easy production, however, a laminate film obtained by laminating a film having a different function is preferable, and a film having a laminate structure of base film/barrier sand film can be mentioned. Moreover, to achieve heat sealability, a film having a laminate structure of base film/barrier sand film/sealant film can be mentioned.

The material of the base film is preferably polypropylene, poly(ethylene terephthalate), nylon and the like. The thickness of the base film is preferably 10-60 μm for polypropylene film, and 10-20 μm for poly(ethylene terephthalate) or nylon film.

The material of the barrier sand film is preferably poly (ethylene terephthalate), aluminum foil or the like vapor deposited with polyvinyl alcohol, polyvinylidene chloride, aluminum and the like. The thickness of the barrier sand film is desirably 5-20 μm for aluminum foil, and 10-30 μm for films made of other materials.

As the material of the sealant film, polyethylene (low density, medium density or high density polyethylene or mixture of one or more kinds thereof), linear low density polyethylene, metallocene polyethylene, ethylene-vinyl acetate copolymer, ionomer polyethylene (Surlyn (trademark)), cast polypropylene, polyacrylonitrile and the like are preferable. From the aspects of impermeability of contents such as drugs and the like and heat sealability, polyacrylonitrile is particularly preferable. The thickness of the sealant film is desirably 10-100 μm. When it is smaller than 10 μm, sufficient adhesion to a blister is difficult to achieve, and when it exceeds 100 μm, the cost increases and the production tends to be difficult.

As mentioned above, to sufficiently maintain the tight-sealing of the package inside, prevent accidental opening during transportation or preservation, and ensure a child-proof package structure, in the blister package of the present invention, the peel strength between blister 1 and cover sheet 2 (that is, peel strength between region 1*a* on the outward side (outermost circumference) of groove 3 of the outer edge section 1A of blister 1 and adhesion parts of cover sheet 2) is preferably greater than the tear strength of the cover sheet. In an embodiment where a cover sheet 2 is adhered to region 1*b* on the inward side of groove 3 in the outer edge section 1A of blister 1, the peel strength between region 1*b* and adhesion parts of cover sheet 2 is preferably smaller than the tear strength of the cover sheet 2.

To be specific, in the present invention, the peel strength between region 1*a* on the outward side (outermost circumference) of groove 3 of the outer edge section 1A of blister 1 and adhesion parts of cover sheet 2 is preferably 12 N/15 mm or above, more preferably 15 N/15 mm or above. While the upper limit of the peel strength is not particularly limited, it is preferably 70 N/15 mm or below, more preferably 50 N/15 mm or below, from the aspects of processability of the sealant film and hot-melt adhesive to be used, cost and the like. Moreover, the peel strength of region 1*b* on the inward side of groove 3 in the outer edge section 1A of blister 1 and the adhesion parts of cover sheet 2 is preferably adjusted to afford a weak adhesion state of 0.5-10 N/15 mm, more preferably 1-7 N/15 mm.

The adhesion mode of blister 1 and cover sheet 2 is not particularly limited, and adhesion by heat sealing, adhesion using pressure sensitive adhesive, adhesion using a hot-melt adhesive and the like can be mentioned.

To set the peel strength between the outermost circumference 1*a* of the outer edge section 1A of blister 1 and the adhesion parts of cover sheet 2 to 12 N/15 mm, heat sealing is preferably performed, for example, using a sealant film. Examples of the material of such sealant film include low density polyethylene, linear low density polyethylene, ethylene-vinyl acetate copolymer, ethylene-vinyl alcohol copolymer resin, polypropylene, metallocene polyethylene resin, polyacrylonitrile resin, non-oriented poly(ethylene terephthalate) and the like. These sealant films may be laminated in advance on a cover sheet 2 as mentioned above, or on blister 1 or on both cover sheet 2 and blister 1. Heat sealing using such a sealant film is preferably performed by applying pressure at 0.1 MPa-2.0 MPa at 100-180° C. for 0.5 sec-2 sec.

For adhesion with a hot-melt adhesive, an olefin hot-melt adhesive is preferably used in view of wettability (affinity) for blister 1 and cover sheet 2. To set the peel strength between blister 1 and cover sheet 2 (peel strength between the outermost circumference 1*a* of outer edge section 1A and adhesion parts of cover sheet 2) to higher than 15 N/15 mm, the adhesive is desirably applied to the outermost circumference 1*a* of the outer edge section 1A of blister 1 at 10 g-70 g/$m^2$. When it is less than 10 g/$m^2$, sufficient peel strength is not afforded, and when it is more than 70 g/$m^2$, the peel strength is hardly improved and the application is economically disadvantageous. When a hot-melt adhesive is used, a blister and a cover sheet are adhered while the hot-melt adhesive is melted by heat, or the applied hot-melt adhesive may be adhered by heat sealing in the same manner as with a sealant film.

When weak adhesion between region 1*b* on the inward side of groove 3 in the outer edge section 1A of blister 1 and a cover sheet is achieved with a sealing film, a peel strength of 0.5 N-10 N/15 mm can be generally afforded by heat sealing the region 1*b* at a temperature lower than that of heat sealing of the outermost circumference 1*a* of the outer edge section 1A of blister 1, or heat sealing is applied in spots or a grid pattern. Alternatively, region 1*b* on the inward side of groove 3 in the outer edge section 1A of blister 1 and a cover sheet may be adhered with an easy peeling type hot-melt adhesive. Such easy peeling type hot-melt adhesive may be of a cohesive peeling type, an interlayer peeling type or an interfacial peeling type, as long as the above-mentioned release force can be provided.

The blister package of the present invention can house various products. Since the package has a structure infants cannot open easily, it is preferable for packing products such as hygiene or medical products, pharmaceutical products and the like which are feared to adversely influence human body, environment and the like when handled inappropriately by infants. Specifically, it is particularly preferable for packaging various known adhesive patches such as a covering patch used for protection of epidermis, a transdermal absorption type adhesive preparation (transdermal absorption patch) used for administration of a transdermally absorbable drug to the body, and the like.

In the present specification, the tear strength of a cover sheet and the peel strength between a blister and a cover sheet were measured by the following methods.

(1) Tear Strength of Cover Sheet

The Elmendorf tear strength was calculated according to JIS K 7128, method B (Elmendorf tear test). The Elmendorf tear strength per one cover sheet was taken as the tear strength of the cover sheet (unit: N).

(2) Peel Strength Between Blister and Cover Sheet

An area of adhesion of a blister and a cover sheet was cut out with a knife in a rectangle strip, and the peel strength was measured according to JIS Z 0237, 180-degree peeling adhesive force test. The adhesion width of the adhesion area was measured, and a load per adhesion width 15 mm was calculated and taken as the peel strength (unit: N/15 mm).

The present invention is explained in more detail in the following by referring to Examples, which are not to be construed as limitative.

Example 1

Shape of Blister

A metal mold for a blister formation (vacuum molding process type metal mold) was prepared to produce a blister of FIG. 1 wherein the bottom of concave portion 1B housing the contents is a square with 40 mm one side, the depth of concave portion 1B is 4 mm, the distance from the concave portion 1B to the end of the outer circumference of an outer edge section 1A (width of outer edge section 1A: W1) is 14 mm, and a groove 3 (width 1.5 mm, depth 1.0 mm) is formed at 6 mm from the end of the outer circumference of the outer edge section 1A, and a blister of the above-mentioned size was molded by subjecting a 350 μm-thick non-oriented poly (ethylene terephthalate) film to vacuum molding processing.

[Cover Sheet]

A laminated sheet made of poly(ethylene terephthalate) film (12 μm)/aluminum foil (7 μm)/polyacrylonitrile film (30 μm) (manufactured by TAMAPOLY CO., LTD., the thickness of each layer is an index value) was used. The thickness of the sheet was measured by a dial gauge (manufactured by OZAKI MFG. CO., LTD., PEACOCK Dial Thickness Gauge H-1A) to find 50 μm, and the tear strength was measured by an Elmendorf method to find 0.5 N.

[Adhesion Mode]

One sheet of craft paper (length 33 mm×width 33 mm×thickness 1.2 mm) used as an adhesive preparation to be enclosed in a blister was placed therein, a cover sheet (polyacrylonitrile film) was placed on the blister such that it contacted the outer edge section of the blister, and the part on the outward side of a groove in the outer edge section (to the end of the outer circumference of the outer edge section) was heat sealed by placing a heating bar on the surface of the cover material (surface temperature 150° C.) at 2.0 MPa for 1 second. The peel strength after heat sealing was measured to find 15 N/15 mm.

Example 2

Shape of Blister

A metal mold for a blister formation (vacuum molding process type metal mold) was prepared to produce a blister of FIG. 3 wherein the bottom of concave portion 1B housing the contents is a square with 40 mm one side, the depth of concave portion 1B is 4 mm, the distance from the concave portion 1B to the end of the outer circumference of an outer edge section 1A (width of outer edge section 1A: W1) is 14 mm, and an ancyroid groove 3 (one side 20 mm, width 1.5 mm, depth 1.0 mm) is formed along one corner of the outer edge section 1A at 6 mm from the end of the outer circumference of the outer edge section 1A, and a blister of the above-mentioned size was molded by subjecting a 350 μm-thick non-oriented poly(ethylene terephthalate) film to vacuum molding processing.

[Cover Sheet]

A laminated sheet made of polyethylene terephthalate) film (12 μm)/aluminum foil (7 μm)/polyacrylonitrile film (30 μm) (manufactured by TAMAPOLY CO., LTD., the thickness of each layer is an index value) was used. The thickness of the sheet was measured by a dial gauge (manufactured by OZAKI MFG. CO., LTD., PEACOCK Dial Thickness Gauge H-1A) to find 50 μm, and the tear strength was measured by an Elmendorf method to find 0.5 N.

[Adhesion Mode]

One sheet of paper (length 33 mm×width 33 mm×thickness 1.2 mm) used as an adhesive preparation to be enclosed in a blister was placed therein, a cover sheet (polyacrylonitrile film) was placed on the blister such that it contacted the outer edge section of the blister, and the part on the outward side of a groove in the outer edge section (to the end of the outer circumference of the outer edge section) was heat sealed by placing a heating bar on the surface of the cover material (surface temperature 150° C.) at 20 MPa for 1 second. The peel strength after heat sealing was measured to find 15 N/15 mm. In addition, the part on the inward side of the groove 3 in the outer edge section (to the end of the inner circumference of the outer edge section) was heat sealed with a heating bar (surface temperature 95° C.) at 2.0 MPa for 1 second. The peel strength after heat sealing was measured to find 2 N/15 mm.

Comparative Example 1

Shape of Blister

A metal mold for a blister formation (vacuum molding process type metal mold) was prepared in the same manner as in Example 1 except that a structure to be the groove 3 was not formed in the blister, and a blister of the above-mentioned size was molded by subjecting a 350 μm-thick non-oriented poly(ethylene terephthalate) film to vacuum molding processing.

[Cover Sheet]

A laminated sheet made of poly(ethylene terephthalate) film (12 μm)/aluminum foil (7 μm)/polyacrylonitrile film (30 μm) (manufactured by TAMAPOLY CO., LTD., the thickness of each layer is an index value) was used. The thickness of the sheet was measured by a dial gauge (manufactured by OZAKI MFG. CO., LTD., PEACOCK Dial Thickness Gauge H-1A) to find 50 μm, and the tear strength was measured by an Elmendorf method to find 0.5 N.

[Adhesion Mode]

One sheet of craft paper (length 33 mm×width 33 mm×thickness 1.2 mm) used as an adhesive preparation to be enclosed in a blister was placed therein, a cover material (polyacrylonitrile film) was placed on the blister such that it contacted the outer edge section of the blister, and the entire area of the outer edge section of the blister (14 mm from the end of outer circumference of outer edge section) was heat sealed by placing a flat heating bar on the surface of the cover material (surface temperature 150° C.) at 20 MPa for 1 second. The peel strength after heat sealing was measured to find 15 N/15 mm.

The blister packages of Examples 1, 2 and Comparative Example 1 prepared above were subjected to cover material breakage operation using the pen point of a ballpoint pen and content removal operation.

The pen point of a ballpoint pen was thrust against the groove of the blister package of Example 1, and moved along the groove to break the cover material for the whole circumference of the outer edge section of the blister. As a result, the cover material was easily broken and the content could be removed with ease without a damage.

The pen point of a ballpoint pen was thrust against the groove of the blister package of Example 2, and moved along the groove to break the cover material. Newly formed broken piece was held with fingers, and the cover sheet was further broken. As a result, the cover sheet adhered on the inward side of the groove in the outer edge section of blister was easily detached. The cover sheet could be detached easily by further breaking the sheet along the area of adhesion in the outer edge section of the blister, and the content could be removed with ease without a damage.

A ballpoint pen was thrust against the concave portion of the blister of the package of Comparative Example 1. However, it was difficult to thrust into the blister without damaging the content. The blister was most easily opened with scissors to remove the content without a damage.

This application is based on a patent application No. 2008-293850 filed in Japan, the contents of which are incorporated in full herein by this reference.

The invention claimed is:

1. A blister package comprising a blister; and a cover sheet, wherein the blister has a groove formed in an outer edge section of the blister, wherein the outer edge section of the blister includes an outer region and an inner region, the groove is formed on the inward side of the outer region, and the inner region is formed on the inward side of the groove, wherein the cover sheet is adhered to the outer region of the outer edge section, the cover sheet is weakly adhered to the inner region of the outer edge section, and the groove is free of adhesion of the sheet, wherein a peel strength between the outer region and the cover sheet is at least 12 N/15 mm, wherein a peel strength between the inner region and the cover sheet is 0.5-10 N/15 mm, wherein the cover sheet has a tear strength of 0.2-1.2 N, and wherein the peel strength between the outer region and the cover sheet is greater than the tear strength of the cover sheet, and the peel strength between the inner region and cover sheet is smaller than the tear strength of the cover sheet.

2. The blister package of claim 1, which is used for a transdermal absorption patch.

3. The blister package of claim 1, wherein the blister includes a concave portion for holding a transdermal absorption patch, the concave portion being disposed on the inward side of the inner region of the outer edge section.

4. The blister package of claim 3, wherein the groove circumscribes the concave portion.

5. The blister package of claim 3, further comprising a transdermal absorption patch disposed in the concave portion.

* * * * *